United States Patent [19]

Tolfsen

[11] Patent Number: 4,733,443

[45] Date of Patent: Mar. 29, 1988

[54] FASTENING MEANS FOR SAFETY BELTS

[75] Inventor: Ulf Tolfsen, Fredrikstad, Norway

[73] Assignee: Loyd's Industri A/S, Boks 609, Fredrikstad, Norway

[21] Appl. No.: 835,940

[22] Filed: Mar. 4, 1986

[30] Foreign Application Priority Data

Mar. 28, 1985 [NO] Norway ..... 851249

[51] Int. Cl.[4] ..... A41F 1/00

[52] U.S. Cl. ..... 24/641; 24/637; 24/643

[58] Field of Search ..... 24/641, 637, 642, 635, 24/638

[56] References Cited

U.S. PATENT DOCUMENTS

| | | | |
|---|---|---|---|
| 3,605,209 | 9/1971 | Alarcon | 24/637 |
| 4,068,354 | 1/1978 | Loomba et al. | 24/641 |
| 4,196,499 | 4/1980 | Tolfsen | 24/641 |
| 4,335,491 | 6/1982 | Fohl | 24/637 |
| 4,454,634 | 6/1984 | Haglund et al. | 24/641 X |
| 4,550,474 | 11/1985 | Doty et al. | 24/637 X |
| 4,575,907 | 3/1986 | Takada | 24/643 X |

FOREIGN PATENT DOCUMENTS

| | | | |
|---|---|---|---|
| 40143 | 11/1981 | European Pat. Off. | 24/641 |
| 2807575 | 8/1979 | Fed. Rep. of Germany | 24/641 |
| 2828082 | 1/1980 | Fed. Rep. of Germany | 24/641 |
| 138431 | 5/1978 | Norway . | |
| 149985 | 10/1983 | Norway . | |
| 2071753 | 9/1981 | United Kingdom | 24/641 |

*Primary Examiner*—Kenneth J. Dorner
*Assistant Examiner*—Laurie K. Cranmer
*Attorney, Agent, or Firm*—Holman & Stern

[57] ABSTRACT

A fastening means for safety belts for cars or the like is especially intended for resisting the high G-forces to which the fastening system is subjected in a collision. Said fastening means essentially comprises a locking flap (2) being provided with a rivet (2*c*), a supporting lug (2*a*), and two hinged arms (2*b*) to be in contact with the turnable about the rear portion of a locking case member (5) shaped with two parallel plates to form an intermediate space (5*f*). Said parallel plates are provided with three through recesses, i.e. one securing hole (5*b*) for securing said fastening means in a car, one hole (5*e*) for receiving the supporting lug (2*d*) of locking flap (2), and a locking hole (5*c*) for guiding and receiving locking flap rivet (2*c*). The locking case member (5), furthermore, is provided with two side walls having recesses (5*d*) for pivotally mounting a blocking flap (3) shaped approximately right-angled one angular leg of which forming a cross bar (3*c*) and the other angular leg (3*a*) being shaped for contact with locking flap (2) and provided with securing members (3*d*) for securing springs (4), which are secured to securing members (1*b*) on expeller (1). Expeller (1) is slidably arranged in the intermediate space (5*f*) in locking case member (5) and the expeller shows two expeller legs (1*c*) and an expeller cam (1*a*) inclined upwards between said expeller legs.

1 Claim, 4 Drawing Figures

FASTENING MEANS FOR SAFETY BELTS

BACKGROUND OF THE INVENTION

1. Field of the Invention

The present invention relates to an improved fastening means for safety belts for cars and the like which fastening means is designed especially for resisting the very high G-forces to which the system is subjected in connection with, e.g. a collision. Said safety belt system may, if desired, also be provided with a device reacting very rapidly to a collision and then causing rapid tightening of the safety belt.

2. Description of the Prior Art

Research of late years disclosed that it is of the utmost importance that a person remains sitting as immovably strapped up to the car seat as possible during a car crash if personal injuries are to be avoided in connection with such a crash. This scientifically supported fact is, inter alia, based on the recognition that only a person being completely strapped up to the car seat will be able to benefit fully from the so called deformation zone inherent in the car which is, in turn, crucial to the stopping distance of the car. As known, very high G-forces occur in a collision and the absolute magnitude of said forces will decrease with an increasing stopping distance. With a slack safety belt system, or if the safety belt is stretched the stopping distance will be reduced and the G-forces will, thus, increase.

From the above mentioned it should be obvious that one should aim at having a person/persons follow the deformation cycle of the car to a highest possible extent in a collision, and to achieve this the person/persons must be strapped up so as to become as immovable as possible during the entire collision cycle.

In order to achieve such a result there are, inter alia, developed pyrotechnic devices causing a tightening of the safety belt in the first phase of a collision. This technology involves G-sensitive members (sensors) to be provided and which are calibrated to react at a certain G-value in the front part of the car. When reacting, said sensors generate a signal that is, e.g. via a detonating fuse or electrically, transmitted to a pyrotechnic charge that is ignited and is connected with the shaft of the belt roll which is, in turn, immediately activated to tighten the safety belt. All this occurs during the initial phase of the collision and before any critical G-values are reached. In this manner the person/persons will be kept strapped up to the car seat and will, thus, be in the most advantageous position to face the crash.

As regards the stretchability of the safety belt system, this should, obviously, be as low as possible, ideally the safety belt system should be "dead". When the pyrotechnic charge is ignited G-forces of 2000 to 3000 G will occur at the moment of ignition and these forces are very rapidly transmitted to the safety belt system and, thus, to the fastening means per se. This momentary tightening involving very high G-forces is, thus very critical to the fastening means since the mechanism of the fastening means will "float". Tightening of the safety belt system mainly occurs in the longitudinal direction of the fastening means with a resulting downward pressure on all members of the fastening means. Conventional fastening means are not designed to resist the above mentioned conditions which, inter alia, imply that the fastening means is subjected to exceptionally high G-forces. Consequently, the fastening means will be rendered more or less inoperative, the mechanism, e.g. being unintentionally opened.

Another fact to be mentioned is that developent tends towards more light-weight cars. This will, inter alia result in said stopping or retardation distances becoming shorter than before. This will, in turn, cause greater stress, inter alia, on the fastening means during the catch up phase following after the rapid tightening phase.

BRIEF SUMMARY OF THE INVENTION

It is an object of the present invention to provide a fastening means for a safety belt that is able to resist the very high G-forces, inter alia, occurring in the initial phases of a collision, when a preliminary tightening of the safety belt system takes place or/and with use of a safety belt system that is not stretchable to any degree worth mentioning, i.e. a safety belt system that is approximately "dead". It will easily be understood that the achievement of said aim is quite critical, since the fastening means must be intact and functional in order to meet and resist the forces that follow and are transferred to the fastening means when the person in question is caught and held firmly by the safety belt system, said forces, in fact, accompanying the entire collision cycle.

The above mentioned object is achieved by a fastening means according to the present invention.

BRIEF DESCRIPTION OF THE DRAWINGS

The present invention will now be described in more detail with reference to the accompanying drawing showing one embodiment, and wherein.

DETAILED DESCRIPTION

Figure 1:
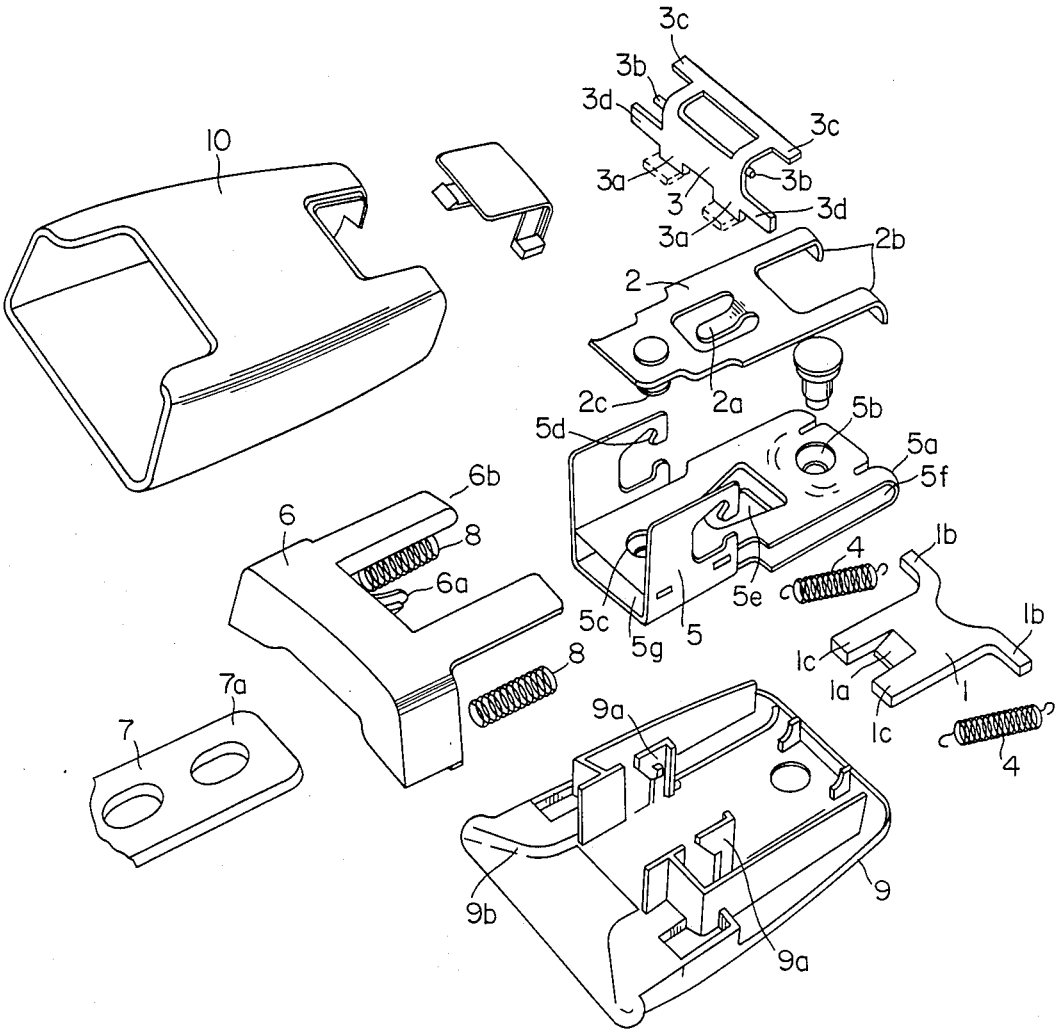
FIG. 1 is an exploded perspective view showing the components of the fastening means of the invention

In FIG. 1 an expeller 1 is shown having an expeller cam 1*a*, expeller lugs 1*b*, and expeller legs 1*c*; a locking flap 2 with its supporting lug 2*a*, its hinge arms 2*b*, and rivet 2*c*; a blocking flap 3 with its legs 3*a*, bearing pin 3*b*, cross bar 3*c*, and lugs 3*d* for securing springs; locking-/expeller springs 4; a case member 5 with its rear portion 5*a*, fixing hole 5*b* for mounting in a car, guide hole 5*c*, and recesses 5*d* for mounting a blocking flap, a recess 5*e* for receiving the supporting lug 2*a* of blocking flap 2, and a space 5*f* between the parallel plates; a push-button 6 having raising cams with a lateral plate 6*a*, and lug cams 6*b*; a locking tongue 7 with its tongue projection 7*a*; push-button springs 8; an interior frame 9 with uprights 9*a* provided with cams to hold a guide the blocking flap, and guide edges 9*b* for guiding locking tongue 7 to be inserted; and an outer casing 10.

Figure 2:
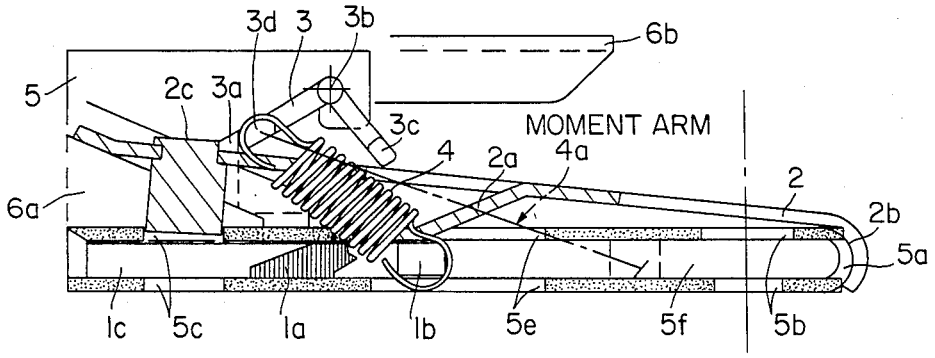
FIG. 2 is a vertical cross-sectional view of the fastening means in an open position.

FIG. 2 shows the fastening means in an open position. Expeller 1 sliding in locking case member 5, in fact, in the space provided between the bottom and top members, respectively, of locking case member 5 is situated in its foremost position and locking/expeller springs 4 are slightly biased. Said springs 4 are at one end secured to expeller lugs 1*b* and at the other end secured to lugs 3*d* of blocking flap 3. By the aid of bearing pins 3*b* said blocking flap 3 is mounted in recesses 5*d* of locking case member 5. Supporting lug 2*a* of locking flap 2 rests on the rear portion of expeller 1, and locking flap 2 is, thus, in an open position. Blocking flap 3 has its legs 3*a* pushing against locking flap 2. The hinge arms 2*b* of locking flap 2 are guided around the rear portion 5*a* of locking case member 5. The locking flap will always be in contact with blocking flap 3 preventing rivet 2*c* of locking flap 2 from disengaging the guide hole 5*c* in locking case member 5. When the push-button is depressed, the raising cams of the push-button 6 with guide plate 6*a* will raise the locking flap 2 to a greatest possible degree.

When nose 7*a* of locking tongue 7 is pushed all the way into the fastening means expeller 1*b* will be pushed inwards into a rear position and locking/expeller springs 4 will have a maximum bias, as indicated in the dotted line 4*a*. In spite of the maximum bias of springs 4 the downward force on blocking flap 3 will not be unfavorably high due to the distance between the center line of force 4*a* and the bearing pins 3*b* of blocking flap 3. In other words, the moment arm is increasingly reduced the further rearward expeller lugs 1*b* are placed.

Figure 3:
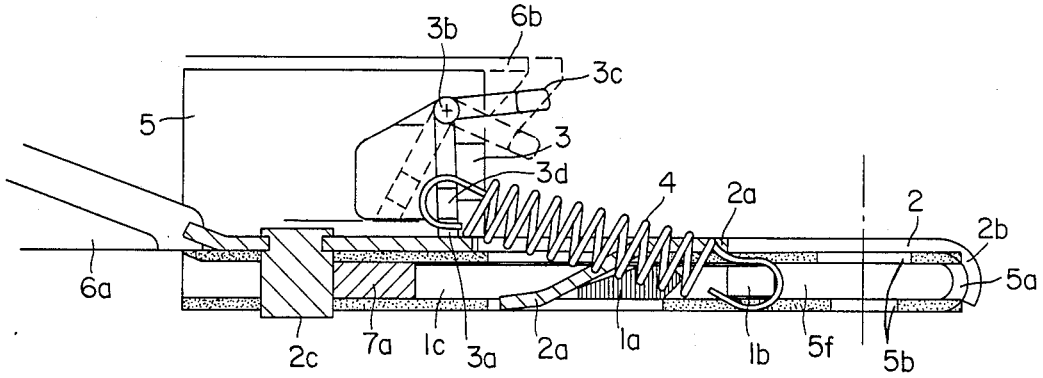
FIG. 3 is a view similar to FIG. 2 showing the fastening means in a locked position.

FIG. 3 shows the fastening means in a locked position. The spring 4 force is now higher and the locking force per se is high due to the fact that blocking flap 3 is lowered into a locking/blocking position and has, thus, an almost maximum moment arm against the spring force. The upper angular leg of blocking flap 3 having cross-bar 3*c* thereon is designed to be as lightweight as possible and the lower angular leg having lugs 3*d* thereon is made relatively heavy.

Locking flap 2 is, now, in a locking position and rivet 2*c* is in place extending through locking hole 5*c* in locking case member 5, and the nose portion 7*a* of locking tongue 7 is pushed against rivet 2*c* by expeller leg 1*c*. Normally, rivet 2*c* will not be in contact with locking case member 5, a fact that will ensure reduced friction in use. When loaded, however, rivet 2*a* will be in contact with the locking case member and this is due to the hinge arms 2*b* which will will yield. In this manner a pure shear force will affect rivet 2*c* resulting in a maximum utilization of the tensile strength of materials.

When said fastening means is opened, the upper cams 6*b* of push-button 6 will initially push cross bar 3*c* of blocking flap 3 down and pass over it. When said cross bar is pushed sufficiently far down the raising cams of push-button 6 with side plate 6*a* will raise locking flap 2. Due to the fact that blocking flap 3 will, now, swing out it is pushed up. When springs 4 are gradually biased the force will only increase marginally because the moment arm is reduced. When locking flap 2 is almost at its uppermost position expeller 1 will expel locking tongue 7 from the fastening means. Expeller cam 1*a* will lift supporting lug 2*a* of locking flap 2 and, thus, hold the locking flap in its upper position.

Figure 4:
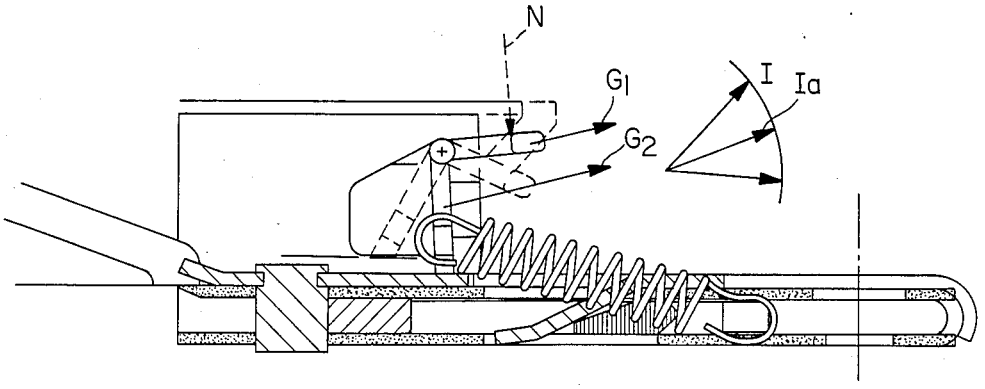
FIG. 4 is a view similar to FIG. 3 showing some of the force components occurring in a collision.

Similar to FIG. 3, FIG. 4 shows the fastening means in a locked position and illustrates the forces affecting the fastening means in cases of high G-loads. I shows a typical section of G-forces in connection with a preliminary tightening of a safety belt. The resultant force Ia is relatively typical. Blocking flap 3 will have its center of gravity beneath bearing pins 3*b* due to the light weight of the upper part of the blocking flap 3, which part includes the cross bar 3*c*. Thus the blocking flap is locked proportionally with the G-load. Push-button 6 will move downward when subjected to a G-load. Both push-button springs 8 and the contact with cross bar 3*c* of blocking flap 3 will hold back. The angle of the upper cams 6*b* of push-button 6 are adapted and balanced in relation to the weight of push-button 6 and, furthermore, the tension of push-button springs 8, and the weight of blocking flap 3, resulting in a static balance in cases of G-loads. The fastening means will, thus, not be opened even though there might be a very high G-load.

In FIG. 4

N = the opening moment of the push-button, and $G_1$ and $G_2$ = the locking moment of the blocking flap along resultant of force Ia.

I claim:

1. In a fastening device for safety belts attached to one part of a safety belt adapted for releasable engagement with a locking tongue having a connecting opening and attached to another part of a safety belt, the improvement for resisting high G-forces arising during a collision comprising:

a one-piece locking case member having two spaced parallel plate portions each having inner and outer sides and forming an intermediate space between said inner sides for receiving said locking tongue therein;

a first pair of holes through said parallel plate portions adjacent one end thereof for securing said fastening device to a vehicle;

a second pair of holes through said parallel plate portions adjacent the other end thereof;

a third pair of holes through said parallel plate portions between said first and second pairs of holes;

two spaced sidewall portions on said case member each extending beyond the outer side of one of said plate portions and having pivot pin receiving recesses therein;

a locking flap adjacent said outer side of one of said plate portions;

a supporting lug extending from said locking flap and insertable into said third pair of holes in the locked position of the fastening device;

two hinge arms on said locking flap engaged with for turning about said one end of said case member;

a rivet member extending from said locking flap and insertable into in guided relationship with said second pair of holes and through the connecting opening in the locking tongue in the locked position;

an expeller member for expelling said locking tongue from said case member slidingly movable in said intermediate space and having two spaced expeller legs engageable with the inserted end of said locking tongue in the locked position;

an expeller cam on said expeller member between said expeller legs and having an inclined surface thereon;

a blocking member having an angularly shaped cross-section formed by two leg portions joined at a joining region and extending at an angle with respect to each other;

one of said leg portions being shaped for releasable blocking engagement with said locking flap in the locked position;

the other of said leg portions having a crossbar as a part thereof;

pivot pins extending oppositely from said joining region of said blocking member pivotally engaging in said pivot pin recesses for pivotally mounting said blocking member;

securing lugs extending oppositely from said one of said leg portions;

securing lugs extending oppositely from said expeller member;

tension securing springs having ends connected respectively to said securing lugs for resiliently urging said expeller member toward the expelling position and for resiliently urging said blocking member toward the blocking position;

an interior frame member for receiving said case member therein;

guide means on said interior frame member for retaining and guiding said blocking flap in the mounted position;

a push-button member movably mounted with respect to said interior frame and case member having lifting means thereon for separately enganging said locking flap and blocking member so that depressing said push button towards said interior frame moves said locking flap and blocking member against the force of said securing springs into tongue-release position so that said expelling member expels said tongue from said case member; and an outer casing.

* * * * *